US005628453A

United States Patent [19]

MacLaughlin

[11] Patent Number: 5,628,453

[45] Date of Patent: May 13, 1997

[54] CUP WITH THERMALLY INSULATED SIDE WALL

[75] Inventor: Donald N. MacLaughlin, Midland, Mich.

[73] Assignee: Packaging Resources, Inc., Coleman, Mich.

[21] Appl. No.: 586,988

[22] Filed: Jan. 16, 1996

[51] Int. Cl.[6] ..... B65D 3/22

[52] U.S. Cl. ..... 229/403; 220/739

[58] Field of Search ..... 229/400, 403, 229/4.5, 404; 220/737, 738, 739, 469; 40/324

[56] References Cited

U.S. PATENT DOCUMENTS

| | | | |
|---|---|---|---|
| Re. 32,739 | 8/1988 | Terauds | 220/306 |
| 2,323,356 | 7/1943 | Rosay . | |
| 2,563,352 | 8/1951 | Morse | 229/403 |
| 2,591,578 | 4/1952 | McNealy et al. | 229/403 |
| 2,899,098 | 8/1959 | Gits . | |
| 3,079,027 | 2/1963 | Edwards | 229/400 |
| 3,082,900 | 3/1963 | Goodman . | |
| 3,189,243 | 6/1965 | Lux | 220/902 |
| 3,203,611 | 8/1965 | Anderson et al. | 229/403 |
| 3,365,092 | 1/1968 | Blessing . | |
| 3,443,715 | 5/1969 | Edwards | 220/469 |
| 3,456,860 | 7/1969 | Janninck | 229/400 |
| 3,589,592 | 6/1971 | Tigner | 229/400 |
| 3,737,093 | 6/1973 | Amberg et al. | 229/400 |
| 3,759,437 | 9/1973 | Amberg | 229/400 |
| 4,133,996 | 1/1979 | Fread | 219/10.55 |
| 4,214,515 | 7/1980 | Kubiatowicz | 99/400 |
| 4,703,149 | 10/1987 | Sugisawa et al. . | |
| 4,708,254 | 11/1987 | Byrns . | |
| 4,796,937 | 1/1989 | Andrea . | |
| 4,801,017 | 1/1989 | Artusi . | |
| 4,801,773 | 1/1989 | Hanlon | 219/10.55 |
| 4,847,459 | 7/1989 | Desai . | |
| 4,851,631 | 7/1989 | Wendt | 219/10.55 |
| 4,892,227 | 1/1990 | MacLaughlin | 220/450 |
| 4,916,280 | 4/1990 | Havette . | |
| 4,926,020 | 5/1990 | Atwell et al. | 219/10.55 |
| 4,988,841 | 1/1991 | Pesheck et al. | 219/10.55 |
| 5,053,594 | 10/1991 | Thota et al. | 219/10.55 |
| 5,101,084 | 3/1992 | Atwell et al. | 219/10.55 |
| 5,222,656 | 6/1993 | Carlson . | |

FOREIGN PATENT DOCUMENTS

| | | |
|---|---|---|
| 4-253642A | 9/1992 | Japan . |

*Primary Examiner*—Gary E. Elkins

*Attorney, Agent, or Firm*—Brinks, Hofer Gilson & Lione

[57] ABSTRACT

An insulated cup includes a tapered side wall that defines an array of spaced, parallel ridges separated by grooves. A label is supported by the ridges around the exterior of the cup to define an array of air gaps in the grooves between the ridges. These air gaps provide thermal insulation tending to reduce heat flow through the label into or out of the cup, and the side wall includes solid resin outer layers and a foamed resin central layer to improve thermal insulation further.

13 Claims, 1 Drawing Sheet

Fig. 3
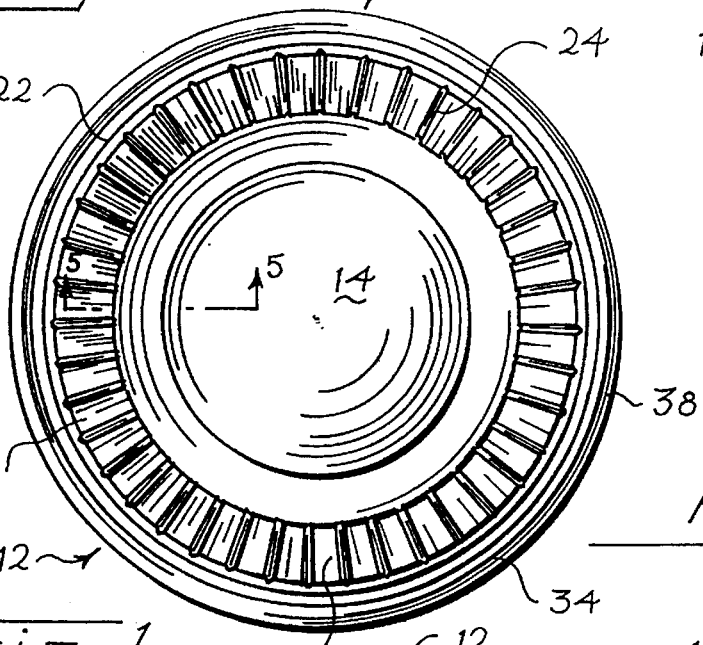
Fig. 2
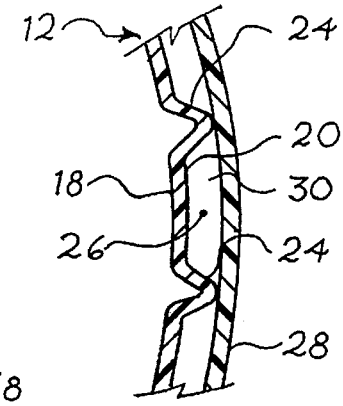
Fig. 4
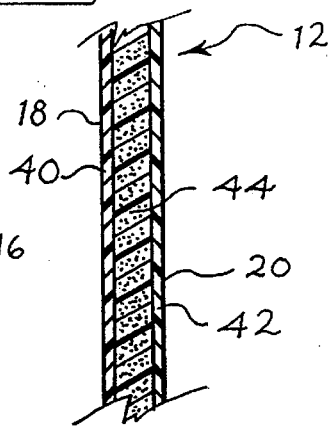
Fig. 1
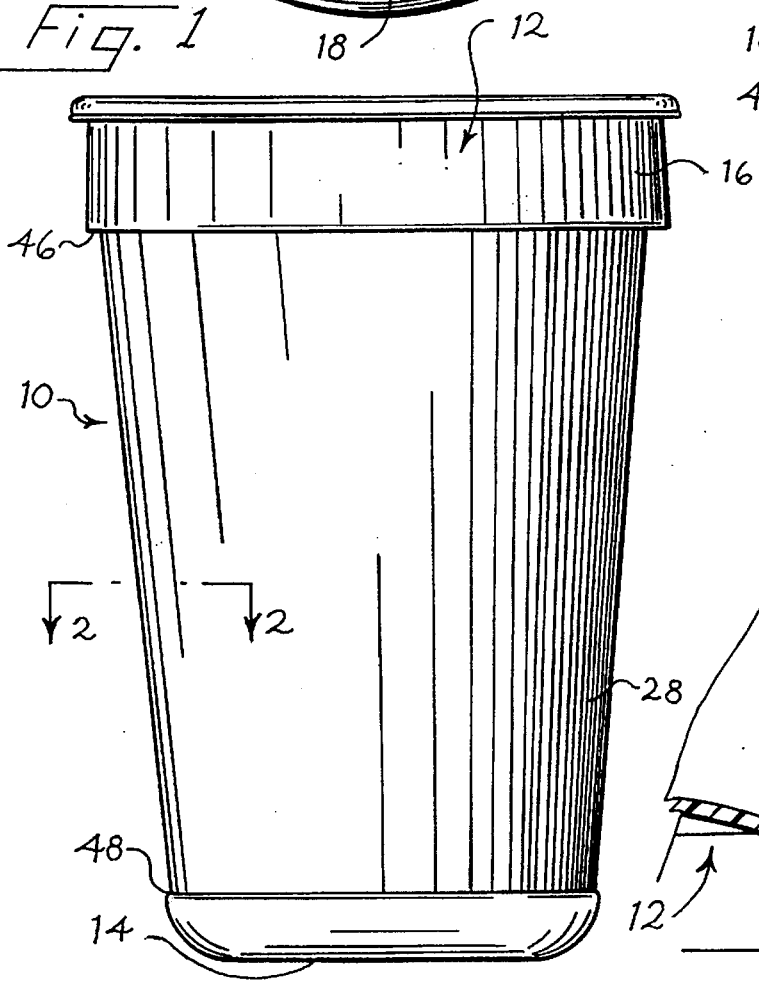
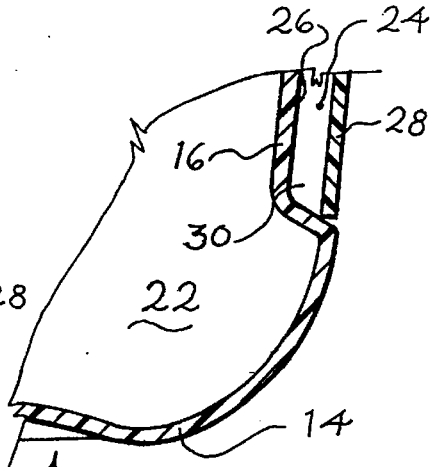
Fig. 5

CUP WITH THERMALLY INSULATED SIDE WALL

BACKGROUND OF THE INVENTION

This invention relates to a cup having improved side wall thermal insulation.

Thota U.S. Pat. No. 5,053,594, Atwell U.S. Pat. No. 5,101,084, Atwell U.S. Pat. No. 4,926,020, Wendt U.S. Pat. No. 4,851,631 and Pesheck U.S. Pat. No. 4,988,841 disclose a range of food containers. As shown in these patents, such containers have been provided with a variety of shapes, including side walls which are either smooth or ribbed.

In the past it has been conventional to provide a cup with smooth sidewalls which are covered with a polystyrene foam label. The polystyrene foam label provides thermal insulation that makes it easier to hold the cup when its contents are heated. This approach places considerable demands on the thermal insulation properties of the label, and thereby restricts the materials that are suitable for commercial applications. This can bring disadvantages. For example, the recyclability of a container with a polystyrene foam label may not be optimum in all applications.

Coffee cups are commonly made of paper or plastic foam. Paper cups may not provide adequate insulation to allow a cup of hot coffee to be held comfortably. Plastic foam cups may not provide a suitably hard outer surface for some applications.

SUMMARY OF THE INVENTION

The present invention is directed to a cup which provides improved thermal insulation to the side wall portions of the cup.

According to this invention, an insulated cup comprises a cup body comprising a bottom portion and an upstanding side wall portion surrounding and continuing the bottom portion to form a beverage-receiving cavity. The side wall portion defines an array of protruding elements extending outwardly from the side wall portion, and a sheet is secured in place on an exterior portion of the side wall portion, in contact with at least some of the protruding elements. The sheet comprises an annular lower edge positioned radially outwardly from at least a part of the bottom portion such that said part of the bottom portion is uncovered by the sheet. The sheet is spaced away from a substantial portion of the side wall portion by the protruding elements to define at least one air gap between the sheet and the side wall portion. This air gap provides thermal insulation tending to reduce heat flow between the sheet and the beverage-receiving cavity, and thereby to facilitate handling of the cup.

BRIEF DESCRIPTION OF THE DRAWINGS

FIG. 1 is a side elevational view of a cup which incorporates a preferred embodiment of this invention.

FIG. 2 is a partial cross-sectional view taken along line 2—2 of FIG. 1, at an expanded scale.

FIG. 3 is a top view of the cup of FIG. 1.

FIG. 4 is a cross-sectional view of the sheet from which the cup of FIG. 1 is formed, at an expanded scale.

FIG. 5 is a partial cross-sectional view taken along line 5—5 of FIG. 3.

DETAILED DESCRIPTION OF THE PRESENTLY PREFERRED EMBODIMENTS

Turning now to the drawings, FIG. 1 shows a cup 10 that includes a body 12, that in turn includes a bottom 14 and a side wall 16. As shown in FIGS. 2 and 4, the interior of the body 12 is defined by a food contact surface 18, and the exterior of the body 12 is formed by an exterior surface 20. The body 12 surrounds and defines a beverage-receiving cavity 22 designed to receive a beverage such as hot coffee, for example.

As best shown in FIGS. 2 and 3, the side wall 16 defines an array of protruding elements such as spaced, parallel ridges 24. The ridges 24 are separated by grooves 26.

As shown in FIGS. 1 and 2, the ridges 24 are substantially covered by a label 28 which in this embodiment is an annular sheet or band of material that extends around the body 12. The label 28 is supported in position by the ridges 24, and as shown in FIGS. 2 and 5 is spaced from the grooves 26. The ridges 24, grooves 26, and label 28 cooperate to define a series of air gaps 30 which perform a thermal insulation function, tending to retard the flow of heat into or out of the beverage-receiving cavity 22 through the label 28. The label 28 covers only the side wall 16, and the bottom 14 is uncovered by the label 28.

As shown in FIG. 3, the body 12 defines an open end 34 which includes a peripheral lip 38. The lip 38 is rolled over to provide a comfortable drinking surface.

As shown in FIG. 4, the body 12 is preferably formed from a sheet having three co-extruded plastic layers 40, 42, 44. In this embodiment the inner layer 40 and the outer layer 42 are preferably formed from a solid plastic material such as polypropylene, and the intermediate layer 44 is preferably formed from a foamed plastic material such as polypropylene. The use of foam in the layer 44 reduces weight and cost and improves the thermal insulation properties of the body 12. The solid plastic layers 40, 42 provide a good surface for printing or labeling and are less prone to damage than the foamed layer 44.

The thermal insulation provided by the body 12 and the air gaps 30 allows a label 28 with moderate or even low thermal insulation characteristics to be used, while still providing sufficient thermal insulation to allow a user to hold the cup 10 comfortably after it has been filled with a heated beverage. For example, the label 28 can be formed of thermally insulating materials such as paper or polypropylene film or sheet. Both materials can be recycled. The use of such materials may in some applications allow a stronger recyclability claim to be made for the cup 10.

The following detailed information regarding the construction of the cup 10 is provided merely to define the best mode of the invention presently contemplated by the inventor. This information is intended by way of example, and it is not intended to limit the scope of the following claims.

By way of example, the relative thicknesses of the three layers 40, 42, 44 can be 10:10:80, respectively, and the layer 44 can have a density of about 60% of the density of the layers 40, 42. The polypropylene resin distributed by Montell as resin #PF814 and the foaming agent distributed by Reedy International as agent #FPE50 have been found suitable.

The ridges 24 can be arranged as 40 equally spaced ribs, each having a height in the radial direction of 0.061 inch. The label 28 can be mechanically held in place such that it can easily be separated from the body 12 if desired. In the cup 10 the label 28 is captured between upper and lower shoulders 46, 48 formed on the side wall 16, and is formed as a band having two ends which are secured together, preferably by means of a suitable mechanical or adhesive connection.

Of course, the present invention is not restricted to the embodiment shown in FIGS. 1–4, and it can be modified as appropriate for the particular application. For example, the size, volume and proportions of the cup can all be varied widely. Furthermore, it is not essential in all embodiments that the protruding elements on the side wall 16 be formed as ridges. It may be preferable in some applications to substitute protruding elements of other shapes, such as an array of raised dimples protruding away from the remainder of the side wall 16. If desired, the label 28 can be secured to the side wall by adhesive. The cup of this invention is not limited to drinking cups, and it can be adapted for use as a sealed food or beverage cup. In this case, the lip may be adapted to seal with a lid (not shown), as for example by heat sealing. The cup of this invention may find use with cold drinks, as well as hot drinks.

It is therefore intended that the foregoing detailed description be regarded as illustrative rather than limiting, and that it be understood that it is the following claims, including all equivalents, which are intended to define the scope of this invention.

I claim:

1. An insulated cup comprising:

a cup body comprising a bottom portion and an upstanding side wall portion surrounding and continuing the bottom portion to form a beverage-receiving cavity, said cup body comprising a plastic material;

said side wall portion forming an array of protruding elements extending outwardly from the side wall portion;

a sheet secured in place on an exterior portion of the side wall portion in contact with at least some of the protruding elements, said sheet comprising an annular lower edge positioned radially outwardly from at least a part of the bottom portion such that said part of the bottom portion is uncovered by the sheet;

said sheet spaced away from a substantial portion of the side wall portion by the protruding elements to form at least one air gap between the sheet and the side wall portion, said air gap effective to provide thermal insulation tending to reduce heat flow between the sheet and the beverage-receiving cavity, and thereby to facilitate handling of the cup.

2. The invention of claim 1 wherein the protruding elements comprise spaced, parallel ridges, and wherein the at least one air gap comprises a plurality of air gaps disposed in spaced, parallel grooves between the ridges.

3. The invention of claim 2 wherein the side wall portion is tapered to progressively smaller dimensions toward the bottom portion, and wherein the sheet is shaped as an annular band that encircles the side wall portion.

4. The invention of claim 3 wherein the band is mechanically held in place on the side wall portion.

5. The invention of claim 4 wherein the band comprises a material selected from the group consisting of paper and polypropylene.

6. The invention of claim 1 wherein the annular lower edge portion insulates the side wall portion only, and the entire bottom portion is uncovered by the sheet.

7. The invention of claim 1 wherein the sheet is shaped as an annular band and the side wall portion comprises at least one shoulder that mechanically captures the sheet in place on the side wall portion.

8. The invention of claim 1 wherein the sheet comprises an annular upper edge portion opposite the annular lower edge portion, and wherein at least one shoulder comprises an upper shoulder positioned adjacent the upper edge portion and a lower shoulder positioned adjacent the lower edge portion.

9. The invention of claim 1 wherein the plastic material comprises a foam layer.

10. The invention of claim 1 wherein the plastic material comprises a solid inner plastic layer, a solid outer plastic layer, and an intermediate foamed plastic layer interposed between the inner and outer layers.

11. The invention of claim 10 wherein at least some of the layers comprise polypropylene.

12. The invention of claim 10 wherein all of the layers comprise polypropylene.

13. The invention of claim 1 wherein the sheet comprises a label.

* * * * *